US005755200A

United States Patent [19]

Henderson

[11] Patent Number: 5,755,200

[45] Date of Patent: May 26, 1998

[54] THROTTLE CONTROL METHOD AND DEVICE FOR OPERATING INTERNAL COMBUSTION ENGINES

[76] Inventor: Henning M. Henderson, 196 Nigel Road, Selcourt, Springs, Gauteng, South Africa

[21] Appl. No.: 785,959

[22] Filed: Jan. 22, 1997

Related U.S. Application Data

[63] Continuation-in-part of Ser. No. 315,816, Sep. 30, 1994, abandoned.

[30] Foreign Application Priority Data

Sep. 30, 1993 [ZA] South Africa ..... 93/4060
Dec. 14, 1993 [ZA] South Africa ..... 93/9352

[51] Int. Cl.[6] ..... F02D 31/00

[52] U.S. Cl. ..... 123/373; 123/376; 123/367

[58] Field of Search ..... 123/365, 367, 123/370, 371, 376, 373, 377

[56] References Cited

U.S. PATENT DOCUMENTS

| | | | |
|---|---|---|---|
| Re. 25,012 | 7/1961 | Dressler | 123/367 |
| 2,139,194 | 12/1938 | Lichtenstein | 123/373 |
| 3,963,091 | 6/1976 | Noddings | 123/357 |
| 4,498,437 | 2/1985 | Ohkoshi | 123/373 |
| 4,566,414 | 1/1986 | Sieber | 123/365 |
| 4,850,320 | 7/1989 | Wokan | 123/365 |
| 5,148,789 | 9/1992 | Shiraishi | 123/367 |
| 5,203,302 | 4/1993 | Parnitzke | 123/376 |
| 5,235,943 | 8/1993 | Fiorenza | 123/376 |
| 5,447,083 | 9/1995 | Henderson | 123/377 |

FOREIGN PATENT DOCUMENTS

| | | | |
|---|---|---|---|
| 3264742 | 11/1991 | Japan | 123/370 |
| 3271529 | 12/1991 | Japan | 123/370 |

*Primary Examiner*—Carl S. Miller
*Attorney, Agent, or Firm*—Jones, Day, Reavis & Pogue

[57] ABSTRACT

A control assembly and method for operating the throttle of an internal combustion engine, in particular, but not exclusively, a diesel engine of a heavy duty vehicle, is provided whereby fuel can be saved by controlling the throttle operation and a driver can be trained to exhibit better driving skills. Detector means detect certain undesirable throttle conditions or movements such as full throttle for an excessive period of time; the number of times a throttle is pumped; and the speed with which the throttle mechanism is moved, and the assembly acts to reduce the fuel supply to the engine to an extent whereat the engine does not lose engine speed to any appreciable extent at constant load, but full throttle is temporarily unavailable.

12 Claims, 5 Drawing Sheets

THROTTLE CONTROL METHOD AND DEVICE FOR OPERATING INTERNAL COMBUSTION ENGINES

RELATED APPLICATION

This application is a Continuation-in-Part of application Ser. No. 08/315,816 filed on 30 Sep. 1994, abandoned.

FIELD OF THE INVENTION

This invention relates to a throttle control method and device for operating internal combustion engines and, more particularly, but not exclusively, internal combustion engines installed in motor vehicles and, still more particularly, heavy duty motor vehicles.

Still more particularly the invention relates to throttle control which is aimed at diminishing the adverse effects of manipulating the throttle control mechanism or accelerator in a manner which is deleterious to the vehicle or engine or simply uneconomical. The adverse effects of particular interest are poor fuel consumption, as well as the increased wear and tear associated with poor or abusive throttle control.

The invention is also concerned with a throttle control method and device which have a driver training function aimed at diminishing the occurrences of poor or abusive throttle control.

The invention is most particularly concerned with diesel powered engines but the same principles generally apply to other engines and the scope hereof is intended to include such other engines.

In this specification the term "manual" or "manually" will be used to mean by human effort irrespective of whether a hand or foot is used. Thus the term "manually operable" includes foot operable.

BACKGROUND TO THE INVENTION

Diesel engines are widely used in many different applications. Probably the most common of these is in motor transport vehicles but numerous other applications include agricultural tractors; earth working machines such as bulldozers, front end loaders, mechanical shovels and the like; fork lift trucks, cranes and locomotives as well as mechanical coal picks; and, stationary applications such as air compressors and the like.

In most of these applications the engine is required to accommodate varying loads and to provide maximum power at times and regularly for significant periods of time, after which reduced power, or in fact no power, may be demanded for other periods of time.

Irrespective of the sophistication of the throttle control means for such diesel engines, at least in the vast majority of instances, when such an engine is operated at maximum or near maximum throttle to achieve maximum or near maximum power from the engine, a correspondingly large amount of fuel is injected into the cylinders of such an engine. This invariably manifests itself in a significant amount of fuel being wasted in the form of partly burnt fuel emitted as black smoke. The emission of such black smoke very often continues for so long as the throttle control mechanism is at or near full throttle settings.

Apart from wasting fuel in the form of smoke excessive operation of an engine at full or near full throttle is often associated with increased wear and tear on the engine.

The matter of damage to an engine caused by excessive engine speed has been addressed by many in that governors of a wide variety are available. One such governor is described in U.S. Pat. No. 2,139,194 to Lichtenstein. Such governors do not, however, assist when an engine throttle is manipulated in a poor or abusive manner at engine speeds less than the set maximum allowable by the governor.

On the other hand various speed control systems have been proposed with a view to automatically maintaining a desired speed of a vehicle. One such system is described in U.S. Pat. No. 3,963,091 to Noddings. Such devices do not take into account the fact of whether or not a throttle is nearly fully open and do not have any effect in improving the situation. In fact, such a device can even be the cause of an excessive fuel flow for an excessive period of time.

It is generally accepted that the provision of a substantially rich fuel mixture in the cylinders is desirable for providing maximum power as and when required. Furthermore, as the engine speed increases, less fresh air is introduced into the cylinders at each stroke although, applicant believes, there is not a corresponding reduction in the amount of fuel introduced into the cylinders. This may be one cause of the introduction of wasted fuel into engine cylinders.

Whatever the cause or rationale of the factors set out above, there is a significant amount of fuel wastage associated with the present throttle operation method and in consequence of presently employed control devices.

It follows that the manner in which the throttle controlling the supply of fuel to an internal combustion engine is manipulated determines, to a substantial extent, the fuel efficiency with which the internal combustion engine operates and, also, to at least some extent, the wear and tear inflicted on the engine. Whilst these comments apply also to stationary internal combustion engines, the problem is, for the most part, most serious in internal combustion engines of motor vehicles, and in particular, heavy duty motor vehicles.

Simply as an example, applicant believes that it is undesirable, or at best uneconomical, to move the accelerator pedal of a motor vehicle too rapidly to open the throttle (usually evidenced by a puff of smoke from the exhaust); to "pump" or repeatedly move the accelerator pedal to open and close the throttle, in particularly from a fully closed to a fully open position; or, to maintain the throttle fully open, or nearly so, for extended periods of time. Such operation of the throttle will be termed "undesirable" in this specification.

All these ways of manipulating a throttle control mechanism or accelerator result in considerable wastage of fuel and also unnecessary wear and tear on the engine.

Of course, these undesirable operations of the throttle are all caused by the driver or operator of the vehicle and are not dictated by any outside forces. Some drivers therefore exhibit less undesirable actions than do others.

In an initial attempt to combat the wastage of fuel consequent on such "undesirable" manner of manipulating a throttle control mechanism, I disclosed in my South African Patent No. 81/4519 a device which "detected" when a throttle control mechanism was in a position corresponding to an undesirably open throttle, and issued an audible signal in the form of a "bleep" to warn the driver to correct the situation. If the driver did not correct the situation within a predetermined period of time, of the order of a few seconds, a "driving fault" would be recorded against the driver. At the same time, the throttle control mechanism, which included a lost motion linkage, would be automatically operated to render it impossible for the driver to use full throttle until the accelerator pedal had been fully released, at which stage the lost motion mechanism would be reset.

Whilst the device proposed in my earlier patent had a generally beneficial effect, it suffers from certain deficiencies, particularly in that the lost motion mechanism may become operative when the driver is in a critical stage of driving and requires the additional power corresponding to a fully or near fully open throttle condition.

Other lost motion linkage assemblies are known in the art for the control of engine and road speeds. See U.S. Pat. Nos. 2,188,704; 3,520,380 and 3,952,714.

Substantial additional research and development on the part of applicant as well as extensive tests, have revealed certain throttle control effects and highly unexpected results which can be achieved by the use of a lost motion linkage of the general nature described, have been achieved.

It is accordingly the object of this invention to provide a throttle control method and assembly of the general type envisaged in my said earlier patent, but wherein the realities of the necessity of requiring full or nearly full throttle at certain times during which driving is taking place are taken into consideration and which, more importantly, do not detract from the practical use of the vehicle or engine.

It is another object of the invention to provide a method of operating an internal combustion engine in a vehicle where the method has a driver training effect which reduces undesirable operations of a throttle mechanism.

SUMMARY OF THE INVENTION

In accordance with one aspect of this invention there is provided a method of operating an internal combustion engine of the type having a manually operable throttle operating mechanism operatively connected to fuel supply control means for the internal combustion engine; the method comprising detecting each time the throttle operating mechanism is moved to a position corresponding to full or near full throttle, allowing the fuel supply control means to adopt a corresponding full or near full throttle condition for a predetermined period of time following said detection after which the fuel supply control means is moved to reduce the fuel flow to the internal combustion engine; and wherein the extent to which the fuel supply control means is moved to reduce fuel flow to the engine is chosen such that, at constant load, in spite of the reduction in fuel flow to the engine, the speed of rotation of the engine remains substantially unaffected at the prevailing load, such movement of the fuel supply control means being unrelated to the actual speed of rotation of the engine.

A particularly important further feature of this aspect of the invention provides for the fuel supply control means to be automatically moved to reduce fuel flow to the internal combustion engine irrespective of the fact that the manually operable throttle operating mechanism remains in a position corresponding to full or near full throttle; and, in such a case, for full throttle operation of the fuel supply control means to be allowed again only subsequent to the manually operable throttle operating mechanism having been moved to a predetermined extent towards a position corresponding to a closed condition of the throttle.

Further features of the invention provide for a linkage which selectively provides for lost motion to be included in the throttle operating mechanism in which case movement of the fuel supply control means to reduce fuel flow to the engine is brought about by activating or de-activating the linkage to provide for said lost motion; for the degree of said lost motion to be adjustable so that the extent of reduction of fuel flow to the engine can be set so as not to significantly affect the engine speed under the prevailing load as required by this invention; and for said reduction in fuel flow to range between 5 and 50% depending on engine characteristics, operating conditions and the like.

The invention also provides a control assembly for operating an internal combustion engine and for controlling the operation of fuel supply control means associated with an internal combustion engine and wherein the fuel supply control means is activated by a manually operable throttle operating mechanism, the control assembly including detector means for detecting when the throttle operating mechanism is in a position corresponding to a full or near full throttle condition; and reduction means for reducing fuel flow to the engine by way of the fuel supply control means when the manually operable throttle operating mechanism is detected as being in a full or near full throttle condition, said control assembly including delay means and having a first condition in which the control assembly allows full throttle condition of the fuel supply control means for a predetermined period of time following which said control assembly is operable to adopt a second condition of the control assembly in which the fuel supply to the engine is reduced with the manually operable operating means remaining in a condition corresponding to full or near full throttle; said control assembly being adjustable such that the extent to which fuel flow to the engine is reduced can be set to provide a fuel flow reduction having substantially no effect on the engine speed under a prevailing constant load and wherein the operation of said control assembly is unrelated to the speed of rotation of the engine.

Further features of the invention provide for reduction means to be a throttle limiting unit having a first condition in which full operation of a throttle is allowed, and a second condition in which somewhat restricted operation of the throttle is available so as to prevent full throttle opening in which case a controller (forming part of the control assembly) is adapted to select which of the two conditions prevail at any particular time; for the detector means to detect the extent of throttle opening or position of the throttle operating mechanism at any time and also, preferably, the speed with which the throttle operating mechanism is moved to an open condition; for the delay means to be embodied in the controller; for the internal combustion engine to be that of a motor vehicle, in particular a diesel engine of a heavy duty motor vehicle; and for the throttle limiting unit to be a linkage which selectively provides for lost motion in a throttle linkage in said second condition.

Still further features of the invention provide for the controller to embody a micro-processor which is adapted to enable the controller operation to be set, selectively, according to signals received from the detector means, between two different sets of parameters, one corresponding to typical city driving conditions, and one corresponding to typical country driving conditions; for the controller to be adapted to determine the rate of change of position of the throttle mechanism and, under city driving conditions, to cause the throttle limiting unit to adopt the second condition in the event that the throttle operating mechanism is moved excessively rapidly; for the controller to be adapted to count the number of accelerator movements within a predetermined time interval corresponding to normal acceleration of a vehicle through the gears and to cause the throttle limiting unit to adopt the second condition when in excess of a predetermined number of throttle operations has been detected within such time interval; for the said period of time to be substantially longer in the country driving mode than in the city driving mode to provide maximum safety during long overtaking manoeuvers; for the controller to be adapted to sense the difference between city driving conditions and country driving conditions in consequence of the time period during which the throttle is maintained in certain positions corresponding to town or country driving behaviour; and for the rate of change of the position of the throttle operating mechanism to be rendered ineffective in the country driving condition.

In accordance with another aspect of this invention there is provided detector means suitable for use in a device as defined above and comprising two parts each adapted for connection directly or indirectly one to a movable part of a throttle operating mechanism, and one to a part which is stationary relative thereto, and wherein the one part comprises a coil and the other part comprises a magnetic substance, the relationship being such that movement of the magnetic substance relative to the coil causes changes in the inductance of the coil with a consequent change in frequency of a signal applied thereto.

Further features of this aspect of the invention provide for the magnetic member to be in the form of an elongate member movable into and out of a hollow core of the coil; for the coil to be energised by a suitable oscillator; and for the elongate magnetic member to be in the form of a rod, in particular a ferrite rod.

The invention still further provides for the throttle limiting unit to be maintained in said first condition by means of an electromagnetic coil in which case the invention provides that, preferably, the polarity of the electrical supply to the electromagnetic coil is reversed at the instant when it is required that the second condition of the throttle limiting unit be adapted. Most conveniently the throttle limiting unit is a linear link of the general type described in my South Africa Patent No. 93/6957 filed under the title "A Linear Link Selectively Providing For Lost Motion".

The invention still further provides for the controller to be programmable as to the exact conditions under which the throttle limiting unit assumes the second condition; in particular, the number of throttle operations allowed in a predetermined time period; the time period for which the throttle can remain in a fully or near full throttle condition both in the city and country driving modes; for the controller to embody an EPROM which renders it programmable; for the programming to be effected by way of a releasable separate programmer unit; and for the programmer unit to assume two different forms, one sophisticated form for effecting major programming at a factory or major installation centre; and, a small unit for effecting minor programming after installation of the control assembly in a vehicle.

In order that the invention may be more fully understood an expanded description thereof, and a description of various embodiments and aspects of the invention, will now follow with reference being made to the accompanying drawings.

DETAILED DESCRIPTION WITH REFERENCE TO THE DRAWINGS

Figure 1:
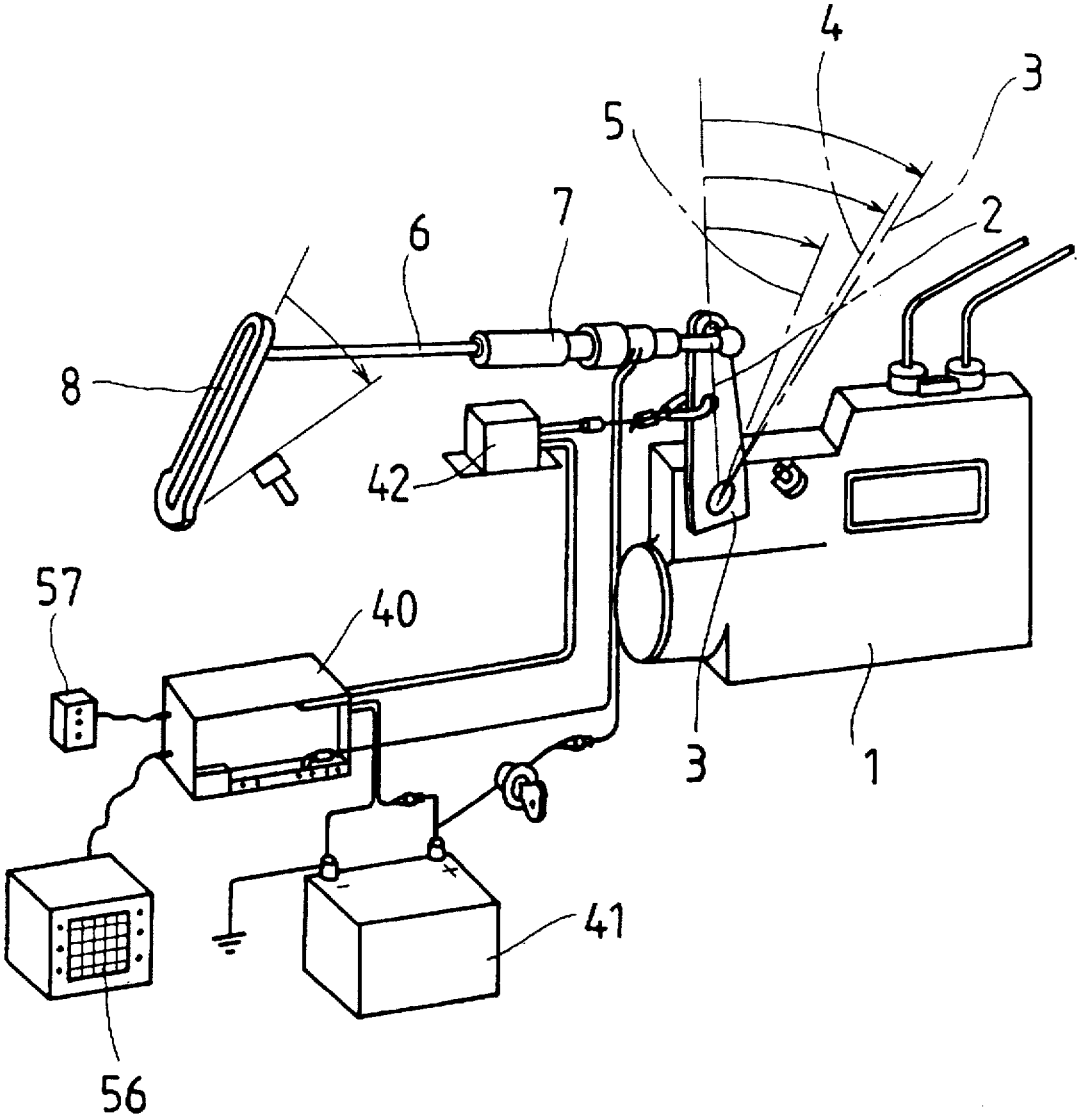
FIG. 1 is a schematic illustration of a motor vehicle diesel fuel injection pump and accelerator assembly with which is associated a control assembly according to one embodiment of this invention.

In the embodiment of the invention illustrated in the drawings, the throttle control assembly provided by this invention is associated with a diesel pump (1) having the usual throttle control arm (2) rotatable about a pivot (3). Various extents of rotation of the arm are illustrated in FIG. 1 as being 100%, 98% and 75% of full opening and the three positions are indicated by numerals (3), (4) and (5) respectively. The significance of this will become more apparent later.

The throttle control lever (2) is illustrated as being moved by a simple, single, axially movable rod (6) embodying within its length a linear link lost motion unit (7) which forms the throttle limiting unit identified above. The rod is shown, for simplicity, as being operated directly by an accelerator pedal (8) whereas, as will be known by those skilled in the art, various different throttle operating mechanisms are used to convey the motion of an accelerator pedal to the throttle control lever.

The linear link (7) is more fully described in my aforementioned South African Patent No. 93/6957 and the description in that complete patent application is included herein by reference. Basically, the linear link comprises two telescopically movable units which are lockable, by means of a solenoid latching mechanism, in a relatively extended position whilst the solenoid is energised and, when the solenoid is de-energised, are allowed to move relative to each other to collapse the length of the linear link to an adjustable extent and provide for lost motion between the accelerator pedal and throttle control arm.

A number of different detailed embodiments of linear link are described in my earlier patent and reference can be had to the specification of that patent for the various arrangements. For the purpose of the present patent application only one embodiment will be described herein simply in order to make the disclosure in this specification comprehensive. This linear link will now be described with reference to FIG. 2.

Figure 2:
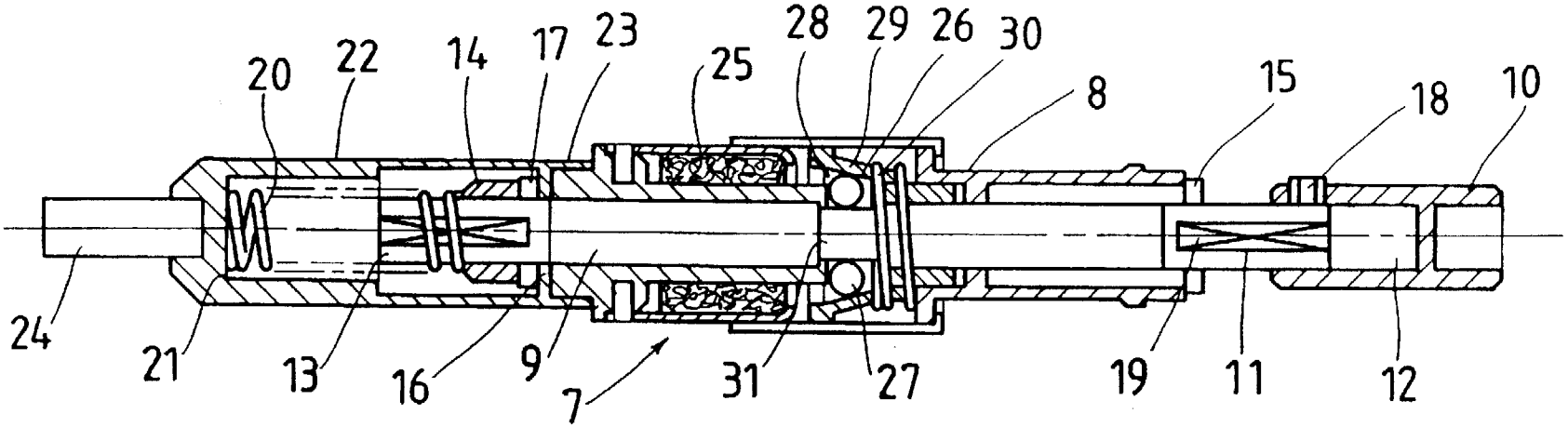
FIG. 2 is an enlarged sectional elevation of one form of linear link provided selectively for lost motion and which may be embodied in the throttle linkage arrangement.

In the arrangement illustrated in FIG. 2, the linear link is of a nature adapted to be in compression when the accelerator pedal is depressed in order to increase fuel flow to the engine. It will be understood by those skilled in the art that there are numerous arrangements in which a linear link of this nature may be in tension in order to open the throttle of an engine and, in such a case, the linear link would be modified as described in my said earlier patent. As illustrated, the linear link (7) comprises basically a composite outer member (8) having a longitudinal bore therethrough and within which is a telescopically movable inner member (9) in the form of a rod.

The inner member has, at its one end, a first coupling member (10) secured thereto by means of a screw-threaded spigot (11) extending into a complimentarily screw-threaded socket (12) on the first coupling member (10). At the other end of the inner member, is a screw-threaded zone (13) on which is located a complimentarily screw-threaded stop member (14) which is axially adjustable in position. In the absence of the arrangement hereinafter described, the outer member is freely movable between a position in which the first coupling member (10) abuts the adjacent end (15) of the outer member and a position in which an inwardly directed flange (16) prevents the stop member (14) from moving further into the outer member.

The extent of this free movement is therefore adjustable, firstly by adjusting the position of the screw-threaded stop member (14) at the one end of the rod and, secondly, by adjusting the extent to which the other screw-threaded end (11) of the rod projects into the screw-threaded socket (12). The stop member (14) is releasably locked in position by means of a lock nut (17) whilst the socket (12) is locked to the screw-threaded spigot (11) by means of a grub screw (18) engaging on suitable flat surfaces (19) provided on the screw threaded spigot.

The two members are spring biased by means of a compression spring (20) acting between the stop member (14) and a blind end (21) to a tubular second coupling member (22) secured at its open end (23) to the outer member (8) and having at its closed end a screw-threaded spigot (24) extending therefrom.

Carried on the outside of the outer member is a co-axial solenoid coil (25). Axially adjacent to the solenoid coil, the wall of the outer member is provided with four equally angularly spaced perforations (26) each of which serves to locate a steel catch element in the form of a spherical ball (27). These balls are held captive by an inner truncated conical surface (28) of an axially movable retainer member (29). The truncated conical surface is directed with the larger end towards the solenoid coil and a light spring (30) urges the retainer member towards the solenoid coil.

In the telescopically extended condition of the linear link as illustrated in FIG. 2, the inner member has a circumferential groove (31) in its outer surface in a position exactly opposite the steel balls (27). The retainer member thus urges the steel balls into engagement with the groove.

This arrangement is such that when the solenoid is de-energised, the strength of the spring (30) is insufficient to prevent the axial compression in the linear link from moving the balls out of the groove and accordingly providing for free movement of the rod within the outer member to the extent allowed by the first coupling (10). A predetermined amount of lost motion, which is adjustable, is therefore provided.

Accordingly, with the balls engaged in the groove (31) in the rod and the solenoid energised, the linear link acts as an incompressible compression member whereas, with the solenoid de-energised, the degree of lost motion indicated is provided.

From the above it will be understood that, when the linear link (7) is in the first condition with the solenoid energised, and the link is fully extended, 100% of the possible movement of the throttle control arm (2) can be achieved by movement of the accelerator pedal.

However, when the linear link is in a collapsed condition (i.e. the second condition described above and when the solenoid is de-energised) there is lost motion in the movement of the accelerator pedal and throttle control lever so that only a proportion of the maximum movement of the throttle control lever can be achieved. It is this degree of lost motion that will give rise to the different extents of possible movement of the throttle control lever indicated by arcs numeral (4) and (5) which corresponds to 98% and 75% of full movement respectively.

These areas of movement correspond to the maximum economic movement of the throttle control lever and will vary from vehicle to vehicle the figures of 98% and 75% simply being arbitrary examples. The exact extent of rotational movement of the control lever which is allowed is adjustable by means of the adjustable stop (14) and first coupling (10) provided on the linear link.

The position of the accelerator pedal which corresponds to the maximum throttle opening in the second condition will, for ease of description, be termed the "latch" position of the accelerator.

Reverting now to the supply of electrical energy to the solenoid, this is controlled by a controller (4) and the electrical energy for both the controller and the solenoid are obtained from the motor vehicle battery (41).

The controller is also connected to a detector unit (42) which has a linearly movable member (43) connected to the throttle control arm (2), or any other suitable part which moves in unison with accelerator pedal (8). Conveniently, the linearly movable member can be the inner of a Bowden cable (44).

Figure 3:
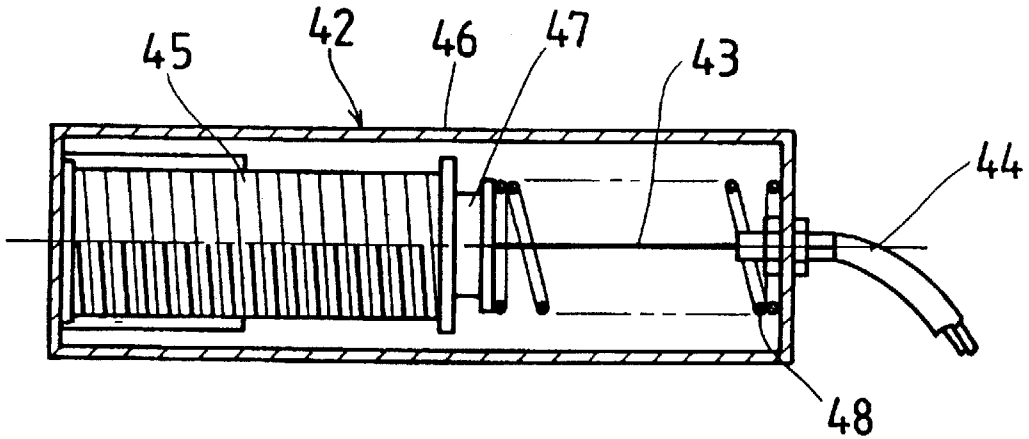
FIG. 3 is a schematic sectional elevation of a detector unit constituting the detecting means of this embodiment of the invention.

Referring now more particularly to FIG. 3, the detector unit comprises a circular cross-sectioned elongate coil (45) fixed relative to a housing (46) and wherein the linearly movable member (43) is attached to a ferrite core (47) movable axially into and out of the hollow core of the coil (45). The ferrite core (47) is biased by means of a compression spring (48) to the inner position and the linearly movable member (43) is adapted to pull the ferrite core out of the coil according to movement of the throttle control lever and thus the accelerator pedal. The arrangement is such that the axial position of the core relative to the coil in consequence of the varying inductance of the coil.

The controller co-operates with the detector unit so that information concerning the position of the core within the coil, or the rate of movement of tbe core into or out of the coil, can be determined by the controller (40).

Figure 4:
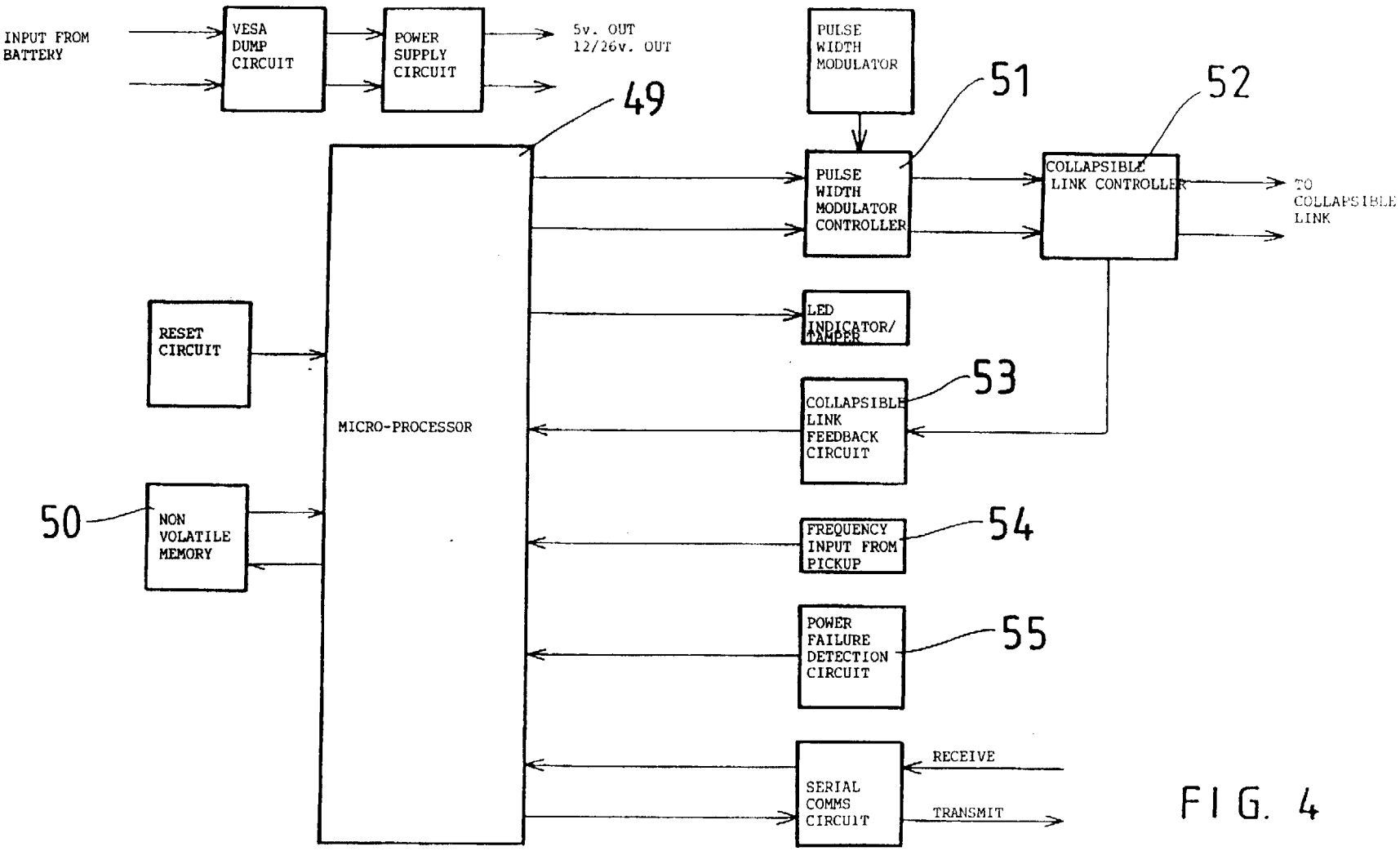
FIG. 4 is a block diagram of the controller circuitry.

Turning now more particularly to FIG. 4, the various functional circuits of the controller are shown in block form. The controller comprises basically a microprocessor (49) connected to a non-volatile EPROM memory (50) which stores the required programmable information. The microprocessor operates, by way of a pulse width modulator controller (51), a linear link controller (52) which controls the power supply to the solenoid of the linear link. The linear link controller is adapted to apply a reverse polarity to the solenoid momentarily at the instant of de-energisation of the solenoid to ensure proper disengagement of the retainer. A feedback circuit (53) is provided from the linear link controller.

The input, which is basically a frequency input (54) from the sensor, is fed to the micro-processor. Also, a power fail detection circuit (55) for the purpose of indicating if the power was removed from the controller is provided.

Any required LED indicators can be provided and, in particular, an LED indicator may especially be provided to indicate whether or not the unit has been tampered with, in particular whether or not the power supply to the unit has been tampered with. Further, if no activity is detected within the micro-processor whilst the motor vehicle ignition is on, the tamper light will be ignited.

Another LED may be installed in the drivers vision to indicate, for example by a slow flash, that the linear link is de-latched and by a fast flash that the controller has detected a full or near full throttle condition of the accelerator.

As indicated above, the micro-processor is programmable and the following is an outline of the items which can be programmed or made adjustable as may be required.

The micro-processor is programmed such that the following activities are allowed or cause de-activation of the solenoid of the linear link to thereby cause the linear link to collapse or adopt the second condition described above.

(1) The accelerator is depressed past the latch position for greater than a pre-set period of time. The time period is sufficiently large to accommodate the normal period of time for which a vehicle is in any gear during a normal series of gear changes to accelerate, for example, from a stand-still. The latter situation exists in the city driving mode. However, in the country driving mode this time period is substantially greater and is sufficient to allow any normal overtaking to be done with the accelerator past the latch position in order to maintain maximum power and, accordingly, maximum safety.

(ii) The micro-processor counts the number of times that the accelerator pedal is depressed past the latch position in a certain time interval. This number is programmable according to the number of gears which the vehicle has, and the manner in which gear changes are achieved. Depressing of the accelerator in excess of the pre-set number of times will cause the linear link to de-latch and the lost motion to limit the movement of the throttle lever arm (2).

(iii) The micro-processor also records the rate of movement of the accelerator pedal, at least in the city driving mode and, if the accelerator pedal is depressed at a speed in excess of a suitable speed, the linear link is de-latched and the throttle limiting unit assumes the second condition in which the throttle opening is limited. The rate of movement of the accelerator to the open position is rendered irrelevant in the country driving mode in order that a driver can accelerate as fast as possible in order to avoid a possibly dangerous situation.

(iv) The number of occasions on which the linear link de-latches is also monitored by the controller and, in the event that de-latching occurs in excess of a predetermined number of times in a predetermined time period de-latching will occur for a prolonged period of time, for example 15 minutes, as a sanction to the driver.

(v) The micro-processor detects when the accelerator has been depressed to an appreciable extent for a duration of time commensurate with country driving behaviour and automatically switches over to the country driving mode. It automatically reverts to city driving mode when the accelerator is substantially released for a short time period.

It will be understood that with the set of variables described, the micro-processor can be programmed so that all normal and necessary driving behaviour, insofar as the accelerator is concerned, is accommodated, and the linear link does not become de-activated, and therefore operative to limit the extent to which the throttle can be opened, whilst satisfactory driving of a vehicle is taking place.

The variables are programmable into the micro-processor and associated EPROM by means of a comprehensive programming unit (56) which has an input keyboard and other necessary switches to program the controller for the type of vehicle with which it is to be used and to include various other variables. This comprehensive programmer unit is simply plugged into the controller as and when required.

In addition, a simple and inexpensive programmer unit (57) can also be plugged into the controller and this programmer unit simply enables the controller, once set for a particular type of vehicle, to be set for the individual vehicle in which it is mounted. This programmer unit enables the controller to be set according to the output from the sensor unit in the idle position of the accelerator pedal; in the 100% depressed condition of the accelerator pedal; and in the selected percentage position of the accelerator pedal chosen according to the vehicle performance figures and set manually on the adjustment nuts of the linear link.

Figure 5:
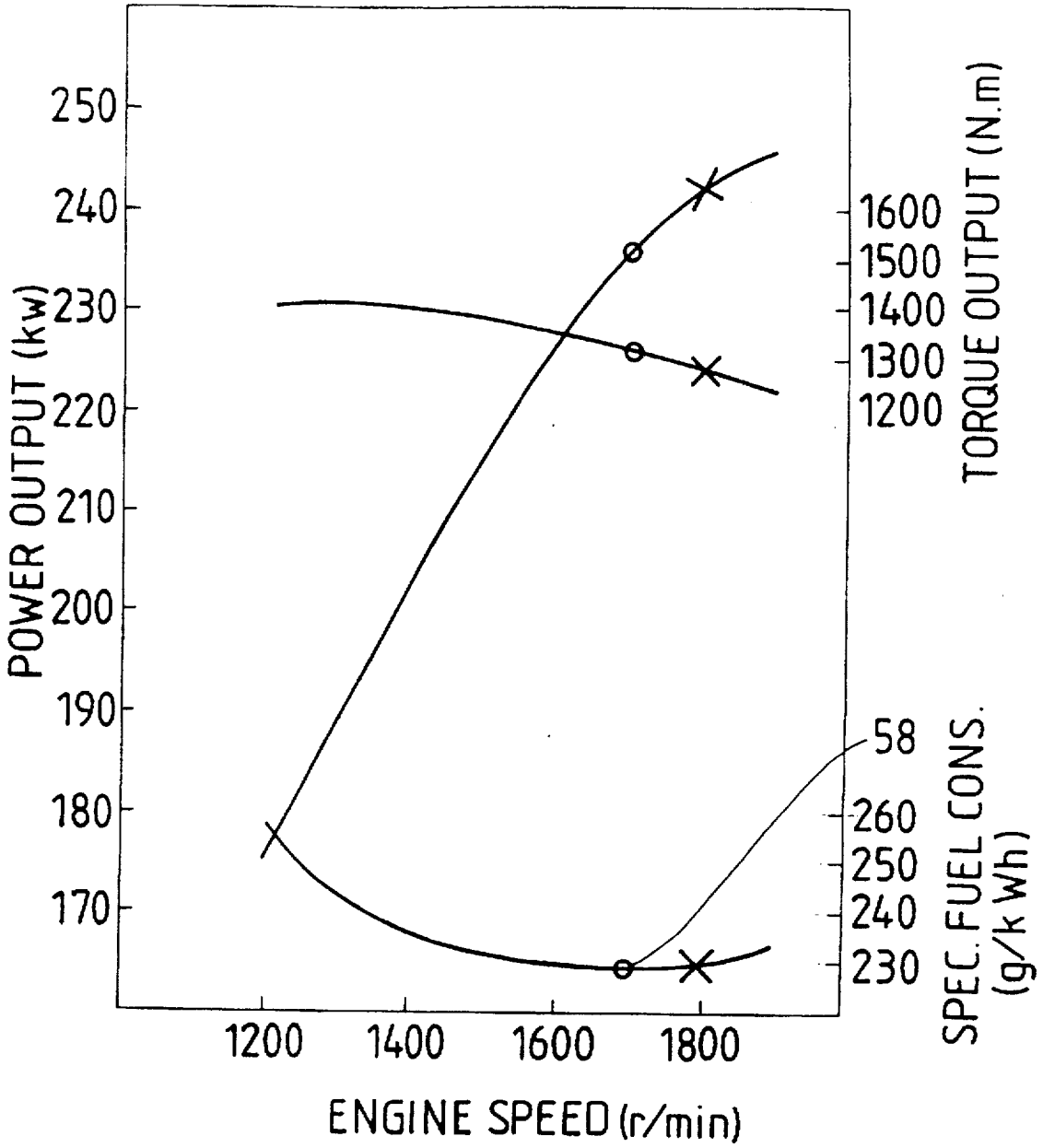
FIG. 5 is a graph illustrating a typical set of power versus engine speed; torque versus engine speed, and fuel consumption versus engine speed curves.

In the latter regard, and referring to FIG. 5, it has been established that the most efficient operating engine speed of a diesel engine is in a predetermined range on the fuel consumption graph being indicated by numeral (58). The percentage of full throttle permitted in the de-latched position (second condition) is chosen such that the engine speed is at or just below the minimum fuel consumption point on the curve as indicated by numeral (58) so that, with the accelerator pedal fully depressed, the engine will be operating at approximately maximum efficiency. As indicated above, the setting of the exact position mechanically is achieved by adjustment nuts or the like associated with the linear link whilst the electrical limits are set using the small or large programmer.

Figure 6:
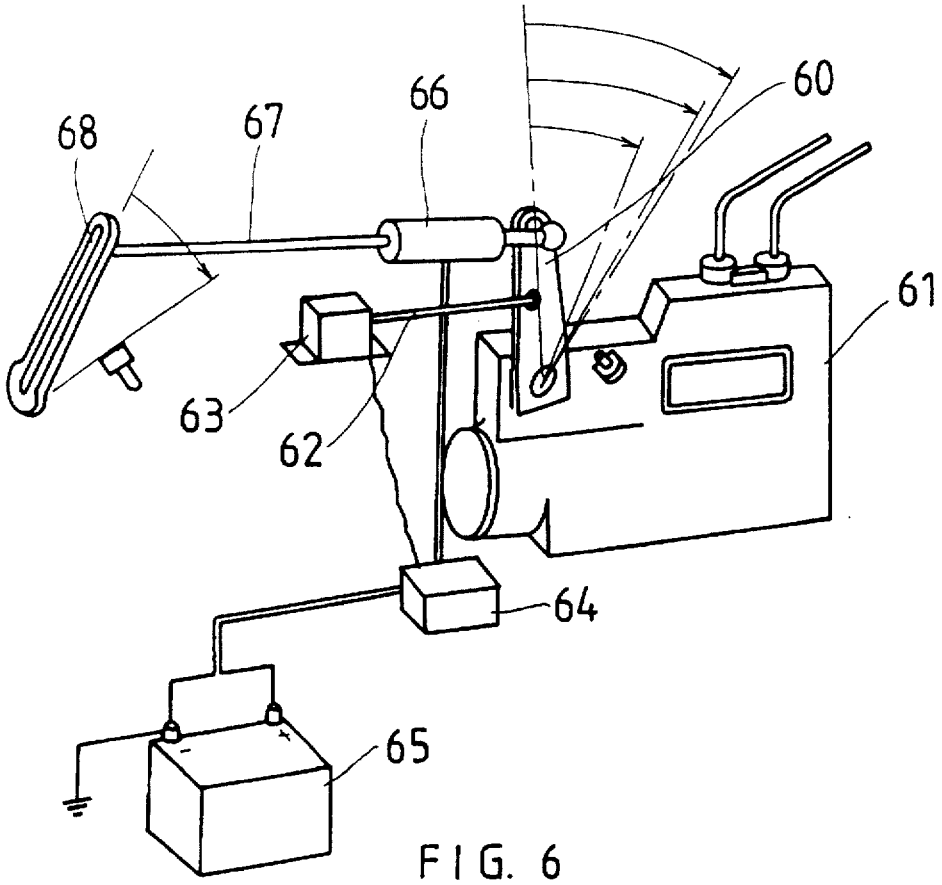
FIG. 6 is a schematic illustration of a diesel pump and simple throttle linkage adapted to operate according to this invention; and, FIG. 7 is a longitudinal sectional elevation of an alternative form of linkage providing for an effective reduction in its length.

The embodiment of the invention described above is aimed at transport vehicles. However, it may well be that a very much simplified arrangement can be used in other applications, such as agricultural tractors and such an embodiment is described with reference to FIG. 6.

In this case, the control arm (60) of the diesel fuel pump (61) is attached, by means of a connection element (62) to a simple switch (63) forming the detector in this case. The switch is connected to a controller (64) which embodies a simple timer, and the apparatus is powered by the motor vehicle battery (65).

In this case a linear link (66) providing for lost motion, and substantially as described above, is included in the linkage (67) connecting the fuel control arm (60) with the accelerator pedal (68).

The linear link (66) is arranged such that lost motion is provided when the solenoid is de-energised through the action of the controller (64) and switch (63).

The switch (63) is such that it is closed when the fuel control arm (60) is in a full throttle or near full throttle condition, and this causes a timer in the controller to operate. After the expiry of the predetermined time, the solenoid is de-energised to provide for lost motion in the linear link, and a corresponding reduction in the fuel supplied to the associated engine, by virtue of the fact that the control arm moves towards a closed position, by a predetermined extent.

In the case of an agricultural tractor working the lands, it has been found that a time period of about 6–10 seconds is adequate to enable the tractor to accelerate to working speed, and to adapt to the load of the ground working or other implement attached thereto, with full fuel flow being provided during this time period. After the lapse of the predetermined time period of between 6 and 10 seconds, the solenoid in the linear link is de-energised and the lost motion is introduced. Accordingly, the fuel supply is diminished by a predetermined extent.

The extent of the lost motion is, as indicated above, adjusted so that when the fuel supply becomes diminished there is substantially no loss in engine speed. Practical tests conducted on an agricultural tractor fitted with a linear link as described above have indicated that the only noticeable difference in performance is the absence of black smoke in the exhaust emission. Also, the agricultural tractor fitted with the device operating according to the invention operated at a more consistent engine speed than an identical agricultural tractor run cotemporaneously but not fitted with the device.

The time period of 6 to 10 seconds may be made to apply only in the "working" gears as those used in the field. In higher gears, used for "driving" or towing, the time period of 6 to 1 0 seconds may need to be extended.

It is envisaged that exactly the same principles and advantages will pertain to application of the invention to air compressors, or other earth working machinery, indeed diesel engines wherever they are accelerated and decelerated periodically as and when they are placed under load for various periods of time.

It is, however, envisaged that the invention will not be applicable to diesel engines which are placed under constant load for prolonged periods of time and wherein the effects of varying fuel supply to the engine are not of interest as the engine can be tuned to operate at its most efficient settings.

It is to be understood that the manner in which the reduced fuel supply is achieved after it has been at substantially full flow rate can be varied widely.

Figure 7:
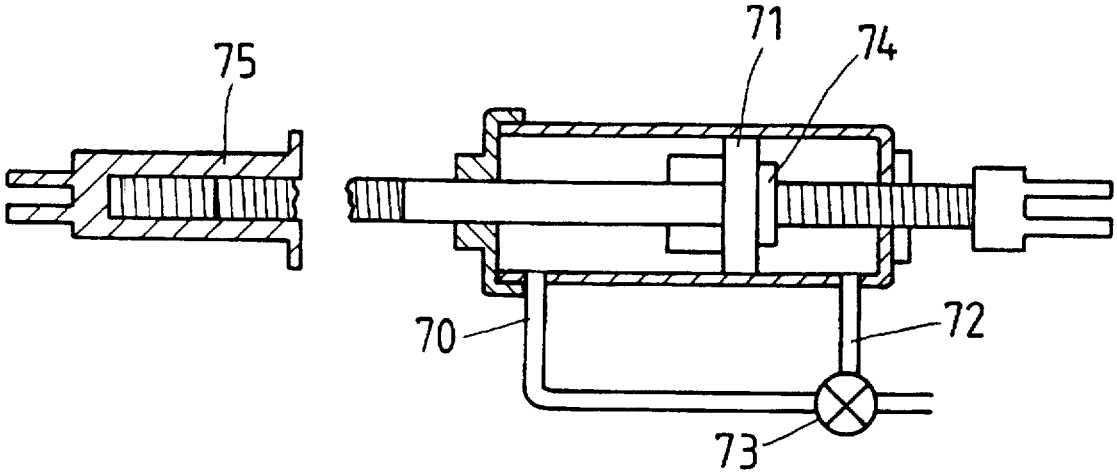

In particular, as illustrated in FIG. 7, a pneumatic or hydraulic piston and cylinder assembly could be employed in which an inlet-outlet (70) on one side of a piston (71) an in inlet-outlet (72) on the opposite side are simply controlled by means of a valve assembly (73), conveniently electrically operated, in consequence of the operation of a controller as described above. Screw-threaded adjustment nuts (74) and (75) enable the extent of the fuel supply reduction to be adjusted as required.

It is to be stressed that one of the methods of this invention as applied to drivers of vehicles has been shown to have the effect of training the drivers so that the occurrences of the reduced fuel condition being implemented becomes fewer as time goes by.

What I claim as new and desire to secure by Letters Patent is:

1. A control assembly for operating an internal combustion engine and for controlling the operation of fuel supply control means associated with an internal combustion engine and wherein the fuel supply control means is activated by a manually operable throttle operating mechanism, the control assembly including detector means for detecting when the throttle operation mechanism is in a position corresponding to a full or near full throttle condition;

reduction means for reducing fuel flow to the engine by way of the fuel supply control means when the manually operable throttle operable throttle operating mechanism is detected as being in a full or near full throttle condition the reduction means being a throttle limiting unit having a first condition in which full operation of the throttle is allowed and a second condition in which somewhat restricted operation of the throttle is available so as to prevent full throttle opening:

said throttle control assembly including a controller forming part of the control assembly and being adapted to select which of the two conditions of the reduction means prevail at any particular time and including delay means embodied therein for allowing full throttle condition of the fuel supply control means for a predetermined period of time following which said control means assembly is operable to adopt a second condition of the control assembly in which the fuel supply to the engine is reduced with the manually operable operating means remaining in a condition corresponding to full or near full throttle and wherein the detector means for detecting the throttle opening or position of the throttle operating mechanisms is connected to the controller to give a signal to the controller:

said control assembly being adjustable such that the extent to which fuel flow to the engine is reduced can be set to provide a fuel flow reduction having substantially no effect on the engine speed under a prevailing constant load and wherein the operation of said control assembly is unrelated to the speed of rotation of the engine.

2. A control assembly as claimed in claim 1 in which the controller embodies a micro-processor which is adapted to enable the controller operation to be set to initiate said second condition of the control assembly according to signals received from the detector means.

3. A control assembly as claimed in claim 2 in which the engine is a motor vehicle engine and two different sets of parameters associated with certain driving operations are selectable, in the alternative, one such set corresponding to driving conditions encountered in city driving and one corresponding to driving conditions encountered in country driving.

4. A control assembly as claimed in claim 3 in which the micro-processor is programmed to select predetermined driving conditions according to signals received from the detector means which are characteristic of city or country driving, as the case may be.

5. A control assembly as claimed in claim 4 in which the characteristic of city or country-driving determined by the controller is the fact that in country driving mode the throttle is significantly open for prolonged periods of time.

6. A control assembly as claimed in claim 3 in which the controller is adapted to sense the rate of change of position of the throttle operating mechanism and to cause the throttle limiting unit to adopt said second condition if such rate of change of position is excessive.

7. A control assembly as claimed in claim 6 in which the said rate of change of position is rendered inactive in the country driving mode.

8. A control assembly as claimed in claim 1 in which the controller is adapted to bring about said second condition of the control assembly in the event of the number of throttle mechanism operations sensed in a predetermined time period exceeds a pre-set maximum number.

9. A control assembly as claimed in claim 8 in which the pre-set maximum number is based on the number of gears of a vehicle in which the control assembly is fitted.

10. A control assembly as claimed in claim 3 to 7 or 9 in which the said predetermined period of time for which full throttle condition is available is substantially longer in the country driving mode than in the city driving mode.

11. A control assembly as claimed in claim 7 in which the sensing means comprises two parts each adapted for connection, directly or indirectly, one to a movable part of a throttle operating mechanism and one to a part stationary relative thereto, and wherein the one part comprises a coil and the other part comprises a magnetic substance, the relationship being such that movement of the magnetic substance relative to the coil causes changes in the inductance of the coil with a consequent change in frequency of a signal applied thereto.

12. A control assembly as claimed in claim 7 in which the throttle limiting unit is a linear link providing for lost motion in said second condition, the link being installed as a linkage in the throttle operating mechanism.

* * * * *